US006103918A

United States Patent [19]

Dahlén

[11] Patent Number: 6,103,918

[45] Date of Patent: Aug. 15, 2000

[54] PROCESS OF PRODUCING GLYCERIDE OIL HAVING A LOW CONTENT OF NON-HYDRATABLE PHOSPHATIDES

[75] Inventor: Josef Dahlén, Karlshamn, Sweden

[73] Assignee: Karlshamns Crushing & Feed AB, Karlshamn, Sweden

[21] Appl. No.: 09/222,871

[22] Filed: Dec. 30, 1998

Related U.S. Application Data

[63] Continuation of application No. PCT/SE97/01206, Jul. 3, 1997.

[30] Foreign Application Priority Data

Jul. 5, 1996 [SE] Sweden ..... 9602662

[51] Int. Cl.[7] ..... C11B 1/02

[52] U.S. Cl. ..... 554/204; 554/8; 554/9; 554/12; 554/15; 554/23

[58] Field of Search ..... 554/205, 8, 9, 554/12, 15, 23

[56] References Cited

U.S. PATENT DOCUMENTS 3,255,220 6/1966 Baer et al. .
4,049,686 9/1977 Ringers et al. .
4,794,011 12/1988 Schumacher .

FOREIGN PATENT DOCUMENTS 0212391 3/1987 European Pat. Off. .
2313224 9/1974 Germany .
675 128A5 8/1990 Switzerland .
WO94/21762 9/1994 WIPO .

*Primary Examiner*—Deborah D. Carr
*Attorney, Agent, or Firm*—Burns, Doane, Swecker & Mathis, L.L.P.

[57] ABSTRACT

A process of producing glyceride oil having a very low content of non-hydratable phosphatides from fatty seeds and fruits is disclosed. In the process, the fatty material is instantaneously and for a very short time exposed to a high temperature at a controlled water content. The glyceride oil extracted from the thermally treated material has after water-degumming the same low contents of phosphorus, iron, calcium and magnesium as can be achieved by treatment with strong acid and alkali (superdegumming) of a conventionally produced glyceride oil.

20 Claims, No Drawings

PROCESS OF PRODUCING GLYCERIDE OIL HAVING A LOW CONTENT OF NON-HYDRATABLE PHOSPHATIDES

This is a continuation of International Application No. PCT/SE97/01206, filed Jul. 3, 1997, that designates the United States of America and which claims priority from Swedish Application No. 9602662-0, filed Jul. 5, 1996.

This invention relates to a process of producing glyceride oil having a low content of non-hydratable phosphatides (phospholipids) from fatty vegetable material.

Vegetable oils are obtained from fatty seeds and fruits by pressing in screw presses or by direct solvent extraction or by prepressing followed by solvent extraction. Rape seeds and sunflower seeds, for instance, have a high fat content and are therefore usually pressed in a first step, whereupon the pressure residue is extracted with a solvent, usually technical hexane. Soybeans are the most common example of a raw material with such a low fat content that a direct extraction gives a sufficiently good yield of fat.

The most important steps in conventional technique for obtaining e.g. rape-seed oil by pressing and solvent extraction will be described below. The method is universal and is applied in all extraction plants with only small differences in the technical design of the plants and their control systems.

1. The dried and cleaned seeds are crushed to flakes in a smooth-rolling mill.

2. The flakes are heated, either in vertical or horizontal "cooker" by means of jacket vapour and, optionally, by addition of live steam. As a rule the time of the heating procedure amounts to 30 to 60 min. The final temperature is in the range of 80 to 110° C. The heating is carried out for several reasons. It implies that the structure of the protein changes in such a manner that the subsequent oil extraction is facilitated. Moreover, it lowers the viscosity of the oil and partly destroys the walls of the fat-carrying cells, which renders the pressing out of oil more easy. It also inactivates quality-impairing enzymes.

3. The hot flakes are pressed in continuously operating screw presses, in which the fat content is lowered from about 40–45% to about 18–20%. The extracted oil is called press oil and the solid residue is called press cake.

Then the treatment follows two routes a) and b). Route a):

4a. The press oil is liberated from accompanying solid particles in e.g. centrifugal decanters or clarifiers, optionally with a subsequent filtering step.

5a. In some cases, water-degumming is then carried out, i.e. 2–3% of water is admixed to the oil, which is centrifuged after a convenient residence time in a container. The main purpose of the centrifugation is to remove hydratable phosphatides and seed particles.

6a. The press oil is then dried in vacuum and cooled before being stored. Route b):

4b. The press cake is extracted with technical hexane in a continuously operating extractor.

5b. The resulting solution of oil in hexane, the miscella, is evaporated in a number of steps for recovering the hexane.

6b. The extraction oil rid of hexane is water-degummed, dried and cooled in the same manner as the press oil. Alternatively, the expressed oil and the extraction oil are mixed before the water-degumming and/or storing.

7b. The extraction residue, the rape-seed meal, is liberated from hexane in a desolventizer by means of live steam and indirect heating.

The extracted oils mainly consist of triglycerides of fatty acids and a considerable number of undesired components, such as phosphatides, colorants and small amounts of metals such as iron, calcium and magnesium. For most purposes, the glyceride oils must therefore be refined for removal of said components.

The phosphatides may be divided into two main groups, viz. hydratable and non-hydratable phosphatides. The hydratable phosphatides can be removed from the oil by treatment with water, whereby the phosphatides become hydrated and insoluble in the oil, from which they can easily be removed by applying simple separating methods. In this degumming, an aqueous lecithin slurry is obtained which after drying gives lecithin. A rape-seed oil which has been subjected to conventional degumming contains non-hydratable, oil-soluble phosphatides, which as a rule gives the oil a phosphorus content in the range of 100–250 ppm.

In the edible fat trade, it is generally considered that the non-hydratable phosphatides as well as particularly iron, which acts as prooxidant, constitute the greatest and most difficult quality problem since they impair the taste of the oil and the stability of the taste at the same time as they are difficult to remove.

The non-hydratable phosphatides must be converted into hydratable phosphatides before they can be removed. This may take place, for instance, by treating water-degummed material with acid or alkali. Ones example involves adding of phosphorous acid, washing with water in a separator and then neutralising the phosphorous acid by adding an excess of alkali. Calcium and maignesium ions, which have been released from the non-hydratable phosphatides, form insoluble phosphate compounds which also render the further processing of the oil difficult.

U.S. Pat. No. 4,049,686 discloses an acid-degumming method, in which oil which preferably has been water-degummed is treated with concentrated acid, such as citric acid, and water. In this context, the phosphatides are hydrated and may thus be removed as a precipitate from the oil. This method is referred to as superdegumming.

With alkali refining and superdegumming, respectively, oils can be obtained having phosphaticie contents of <10 ppm and 15–30 ppm, respectively (determined as phosphorus. These contents, however, are not sufficiently low to satisfy the increasing requirements in the industry.

WO 94/21762 discloses a process of preparing degummed glyceride oils, which comprises applying an acid-degumming treatment to a crude glyceride oil which has not substantially been exposed to enzymatic activity. The crude glyceride oil has been obtained by heating and pressing glyceride-oil-containing vegetables material, optionally preceded by a cold pressing step, where the heating takes place in two steps, the vegetable material being first exposed to a temperature of 30–80° C. for 0.1–20 min and then to a temperature of 80–140° for 1–60 min. This degummed oil is said to give a phosphatide content (determined as phosphorous) of 0.1–7 ppm. This process takes a relatively long time, and the oil extracted from the vegetable material must be degummed by treating it with acid, which renders the process expensive. The added acid must besides be neutralised by adding alkali, which further deteriorates the process from the viewpoint of expense and environment.

It has now surprisingly been found that glyceride oils having a low content of non-hydratable phosphatides and a low content of iron, calcium and magnesium can be produced from fatty vegetable material by changing step 2 in the conventional oil extraction process as described above. After changing step 2, but without changing the subsequent steps, a water-degummed oil is obtained, which in every essential respect is comparable with a conventionally produced water-degummed oil, which has then been subjected to superdegumming. The process is easy and very cost-effective at the same time as it is very satisfactory from the environmental point of view since no additional chemicals are required for degumming. The adverse effect on the environment is further reduced by the possibility of the phosphatide slurry, unless used for production of lecithin, alternatively being recycled to the extraction residue which is used as livestock feed.

These advantages are achieved by the conventional technique, with slow heating in cooker to a relatively low temperature, being replaced by the inventive process, in which the fatty vegetable raw material is instantaneously exposed to a high temperature at a controlled content of water before extraction of the glyceride oil.

It is known that the enzyme systems in the vegetable material are inactivated at a considerably lower temperature than the one here achieved. However, it has not been clarified whether merely the enzyme inactivation causes the effects achieved by the invention. Without being bound by any theory, it is possible that also thermal degradation and conversion of certain phosphatides promote an increase of the hydratability and a reduction of the solubility in the oil phase.

Suitable fatty vegetable materials for this oil extraction technique are oil plant seeds, whose oils, after conventional extraction, contain non-desirable contents of non-hydratable phosphatides, which requires that they be treated by superdegumming. In particular, mention may be made of rape seed, turnip rape seed, soybeans, sunflower seed, mustard seed and linseed, rape seed and turnip rape seed being especially preferred. With a view to facilitating the treatment of the vegetable material, this should be crushed mechanically before being exposed to the high temperature.

In an embodiment of the invention, the temperature of the fatty material is increased instantaneously from storage temperature to at least 140° C., prefferably to 145–155° C., which temperature is then maintained for 10–120 s, preferably 10–30 s.

The water content of the fatty material is suitably set at 4–18% by weight during the treatment, and particularly good results are achieved if the water content in the introductory part of the treatment at a high temperature is set at 12–16% by weight, and then in the final stage of the treatment is reduced to 4–7% by weight.

Summing up, it may be said that by applying the process according to the invention when treating the fatty raw material before oil is extracted, a crude oil is obtained, which has the same low contents of non-hydratable phosphatides as have previously been achievable merely by treating the extracted crude oil with chemicals according to one of the methods which are generally referred to as superdegumming.

By means of the process according to the invention, an oil is obtained, which after water-degumming has:

- a phosphorus content of non-hydratable phosphatides of less than 5 ppm
- an iron content of less than 0.2 ppm
- a calcium content of less than 4 ppm
- a magnesium content of less than 2 ppm The carrying out of the inventive process requires a device for accomplishing the instantaneous increase in temperature of the vegetable material.

A suitable device may consist of a closed, pressurised conveying loop, in which superheated steam is circulated by means of a centrifugal blower. The conveying loop is suitably provided with gas-tight supplying and discharging means, heat exchangers for controlling of temperature and water content, and a cyclone for separating solid material. The pressure of the steam may be varied between, for instance, 2 and 5 atmospheres. When the material to be treated is supplied to the pressurised system, steam condenses on each individual particle and increases its temperature and water content to a desired level. Moreover, the material is conveyed by the steam, at the set pressure and temperature, to the cyclone, where it is discharged from the plant by means of a gas-tight gate-type feeder.

The invention will now be described in more detail by means of the following Examples.

EXAMPLE 1

A conventional plant for extraction of rapeseed oil by pressing and solvent extraction is used for carrying out the experiment. Its composition is evident from the conventional technique described by way of introduction. The plant comprises five stack cookers, and a screw press is connected to each cooker.

In the experiment, about 6 tonnes of Swedish flaked rape seed an hour were treated in each of the five screw presses. Four of the presses (reference presses) were supplied with rapeseed flakes, the temperature of which had been increased to about 90° C. in the four associated cookers. The residence time in each cooker was about 40 min. The water content of the flakes was about 6.1% when being fed to the presses.

The fifth cooker was shut off and the rapeseed flakes were instead thermally treated in the above-described closed, pressurised conveying loop. After this thermal treatment, which was carried out at about 150° C. and lasted about 30 s, the flakes were pneumatically conveyed to the inlet of the fifth press (test press). The water content of the flakes was then about 5.6%.

Oil samples were taken in the outlets of the reference presses and in the outlet of the test press.

Each oil sample was degummed in a laboratory centrifuge after adding 3% water and after swelling for 10 min. The values of an analysis are stated in Table 1.

EXAMPLE 2

The experiment was carried out in the same manner as in Example 1 except that the rape seed had been imported from Poland and was estimated to have a quality different from that used in Example 1. The treating capacity of each press amounted to about 6 tonnes of rapeseed flakes an hour. The water content of the flakes was 5.2% when being supplied to the reference presses and 4.1% when being supplied to the test press. Oil samples were taken in the outlets of the reference presses and in the outlet of the test press. Each oil sample was degummed in a laboratory centrifuge after adding 3% water and after swelling for 10 min. In this experiment, also calcium and magnesium in the crude oil were analysed. The values of the analysis are stated in Table 2.

TABLE 1

| Pressed oil from Swedish seed | Test oil prepared according to the invention | Comparative oil |
|---|---|---|
| Water content in oil, % | 0.18 | 0.14 |
| Phosphorus in crude oil, ppm | 350 | 240 |
| Phosphorus after water-degumming, ppm | 4 | 165 |
| Iron in crude oil, ppm | 1.5 | 2.9 |
| Iron after water-degumming, ppm | 0.04 | 0.7 |
| Calcium after water-degumming, ppm | 2.8 | 93 |
| Magnesium after water-degumming, ppm | 0.8 | 29 |

TABLE 2

| Pressed oil from Polish seed | Test oil prepared according to the invention | Comparative oil |
|---|---|---|
| Water content in oil, % | 0.13 | 0.07 |
| Phosphorous in crude oil, ppm | 410 | 270 |
| Phosphorous after water-degumming, ppm | 4 | 57 |
| Iron in crude oil, ppm | 5.8 | 10 |
| Iron after water-degumming, ppm | 0.1 | 0.6 |
| Calcium in crude oil, ppm | 49 | 112 |
| Calcium after water-degumming, ppm | 2 | 59 |
| Magnesium in crude oil, ppm | 30 | 46 |
| Magnesium after water-degumming, ppm | 1 | 17 |

What is claimed is:

1. A process of producing glyceride oil having a low content of non-hydratable phosphatides from fatty vegetable material, characterised in that the fatty vegetable material is instantaneously exposed to a high temperature at a controlled water content in a closed, pressurised conveying loop, in which super-heated steam is circulated, whereupon glyceride oil is extracted.

2. A process as claimed in claim 1, characterised in that the fatty vegetable material, if required owing to the particle size, is crushed or flaked before being exposed to a high temperature.

3. A process as claimed in claim 1, characterised in that the temperature of the fatty vegetable material is instantaneously increased to at least 140° C., which temperature is then maintained for 10–120 s.

4. A process as claimed in claim 1, characterised in that the water content of the fatty vegetable material is varied in the range of 4–18% by weight.

5. A process as claimed in claim 1, characterised in that the temperature is instantaneously increased to 145–155° C.

6. A process as claimed in claim 1, characterised in that the high temperature is maintained for 10–30 s.

7. A process as claimed in claim 1, characterised in that, as the treatment at a high temperature is initiated, the water content of the fatty vegetable material is set at 12–16% by weight and in the final stage of the treatment is reduced to 4–7% by weight.

8. A process as claimed in claim 1, characterised in that the glyceride oil, by pressing and/or extraction, is obtained from the fatty vegetable material treated at a high temperature.

9. A process as claimed in claim 1, characterised in that the glyceride oil is degummed by treatment with water without adding acid or alkali.

10. A process as claimed in claim 1, in that the fatty vegetable material consists of oil-containing seeds or fruits.

11. A process as claimed in claim 2, characterised in that the temperature of the fatty vegetable material is instantaneously increased to at least 140° C., which temperature is then maintained for 10–120 s.

12. A process as claimed in claim 2, characterised in that the water content of the fatty vegetable material is varied in the range of 4–18% by weight.

13. A process as claimed in claim 3, characterised in that the water content of the fatty vegetable material is varied in the range of 4–18% by weight.

14. A process as claimed in claim 2, characterised in that the temperature is instantaneously increased to 145–155° C.

15. A process as claimed in claim 3, characterised in that the temperature is instantaneously increased to 145–155° C.

16. A process as claimed in claim 2, characterised in that the high temperature is maintained for 10–30 s.

17. A process as claimed in claim 2, characterised in that, as the treatment at a high temperature is initiated, the water content of the fatty vegetable material is set at 12–16% by weight and in the final stage of the treatment is reduced to 4–7% by weight.

18. A process as claimed in claim 2, characterised in that the glyceride oil, by pressing and/or extraction, is obtained from the fatty vegetable material treated at a high temperature.

19. A process as claimed in claim 2, characterised in that the glyceride oil is degummed by treatment with water without adding acid or alkali.

20. A process as claimed in claim 2, characterised in that the fatty vegetable material consists of oil-containing seeds or fruits.

* * * * *